US010167596B2

(12) United States Patent
Calby

(10) Patent No.: US 10,167,596 B2
(45) Date of Patent: Jan. 1, 2019

(54) PIVOTABLE LAMP SUPPORT STRUCTURE

(71) Applicant: AMERICAN LOUVER COMPANY, Skokie, IL (US)

(72) Inventor: Daniel Calby, Park Ridge, IL (US)

(73) Assignee: AMERICAN LOUVER COMPANY, Skokie, IL (US)

( * ) Notice: Subject to any disclaimer, the term of this patent is extended or adjusted under 35 U.S.C. 154(b) by 0 days.

(21) Appl. No.: 15/409,814

(22) Filed: Jan. 19, 2017

(65) Prior Publication Data

US 2017/0204574 A1 Jul. 20, 2017

Related U.S. Application Data

(60) Provisional application No. 62/280,359, filed on Jan. 19, 2016.

(51) Int. Cl.

| | |
|---|---|
| ***E01F 9/00*** | (2016.01) |
| ***E01F 9/688*** | (2016.01) |
| ***E01F 9/654*** | (2016.01) |
| ***E01F 9/615*** | (2016.01) |
| *F21W 111/02* | (2006.01) |

(52) U.S. Cl.

CPC ..... *E01F 9/688* (2016.02); *E01F 9/615* (2016.02); *E01F 9/654* (2016.02); *F21W 2111/02* (2013.01)

(58) Field of Classification Search

CPC . E01F 9/688; E01F 9/692; E01F 9/654; F16B 9/026; F16B 17/00; F21S 8/08; F21V 21/145; F21V 21/26; F21V 21/28; F21V 21/30

See application file for complete search history.

(56) References Cited

U.S. PATENT DOCUMENTS

| | | | | | |
|---|---|---|---|---|---|
| 2,648,761 | A * | 8/1953 | Shamel | E01F 13/02 | 160/351 |
| 2,800,601 | A * | 7/1957 | Martin | H05B 41/34 | 313/318.01 |
| 3,015,804 | A * | 1/1962 | Nunn | E01F 13/02 | 116/63 P |
| 3,697,738 | A * | 10/1972 | Decker | B60Q 7/005 | 116/63 P |
| 3,818,439 | A * | 6/1974 | Maine | F21L 2/00 | 340/331 |
| 4,083,033 | A * | 4/1978 | Kulp | E01F 13/02 | 116/63 P |
| 4,387,416 | A * | 6/1983 | Decker | F21S 8/00 | 362/190 |

(Continued)

*Primary Examiner* — Ismael Negron

(74) *Attorney, Agent, or Firm* — McDermott, Will & Emery LLP

(57) ABSTRACT

A support element includes a bore; a boss surrounding the bore and having an offset surface at an angle to the bore axis; and a counterbore formed opposite the boss relative to the bore and substantially coaxial with the bore, having a counterbore surface substantially orthogonal to the bore axis and a counterbore angled surface at an angle to the bore axis and corresponding to the offset surface. A bolt, including a head portion received in the counterbore and a threaded portion received at least partially within the bore, couples an illumination device to the support element, such that the illumination device is capable of being pivoted about the bore axis and a transverse axis orthogonal to the bore axis.

20 Claims, 5 Drawing Sheets

(56) References Cited

U.S. PATENT DOCUMENTS

| | | | | | |
|---|---|---|---|---|---|
| 4,516,109 | A * | 5/1985 | Thurston | E01F 13/02 | 116/63 R |
| 4,772,990 | A * | 9/1988 | Linehan | F21S 9/022 | 136/206 |
| 5,156,446 | A * | 10/1992 | Lister | E01F 13/028 | 340/908.1 |
| 5,342,140 | A * | 8/1994 | Glass | E01F 13/02 | 116/63 R |
| 6,305,312 | B1 * | 10/2001 | Bent | E01F 9/688 | 116/63 P |
| 7,093,953 | B1 * | 8/2006 | Dicke | B60Q 7/00 | 340/907 |

* cited by examiner

PIVOTABLE LAMP SUPPORT STRUCTURE

CROSS-REFERENCE TO RELATED APPLICATIONS

This application claims the benefit of U.S. Provisional Patent Application No. 62/280,359, filed Jan. 19, 2016, which is expressly incorporated herein by reference and made a part hereof.

TECHNICAL FIELD

The present disclosure generally relates to a mechanical attachment system. In particular, a handle is provided with a pivoting mount.

BACKGROUND

Standard traffic drums are generally known in the art. Some traffic drums include features such as a pivoting light for enhanced visibility and storage properties. Other traffic drums include a mounting interface for a tire section for enhanced drum stability. However, conventional pivoting mountings found on existing traffic drums hinder pivoting operations of the light and cause drum damage during pivoting operations. These conventional pivoting mounts induce stresses into a drum upper surface, drum handle or light mount during a pivoting process, or when the pivoting mount is disposed in a pivoted or deployed orientation. The accessories or integrated features available on these and other known traffic drums do not safely and purposefully address these issues. The present disclosure seeks to overcome some limitations and other drawbacks of the prior art, and to provide new features not heretofore available. A full discussion of the features and advantages of the present disclosure is deferred to the following detailed description, which proceeds with reference to the accompanying drawings.

SUMMARY

In some implementations of the present disclosure, a pivoting system provides a pivoting mount rotatably attached to a handle, the pivoting mount being selectively positioned in a pivoted state and an extended state, a bolt for rotatably connecting the pivoting mount to said handle, a bore formed in the handle, the bolt being disposed at least partially within said bore and the bore defining a bore axis, a boss and a counterbore formed in the handle, the boss including a boss surface substantially perpendicular to the bore axis and a boss angled surface offset from the boss surface by a first acute angle, the counterbore including a counterbore surface substantially perpendicular to the bore axis and a counterbore angled surface offset from the counterbore surface by a second acute angle.

In some implementations of the present disclosure, a traffic drum provides a base, a drum upper surface disposed substantially opposite from the base on the drum, a pivoting mount rotatably attached to a handle, the handle being disposed on the drum upper surface, and the pivoting mount being selectively positioned in a pivoted state and an extended state, a bolt for rotatably connecting the pivoting mount to the handle, and a bore, a counterbore, and a boss disposed in the handle, the bolt being disposed at least partially within the bore, the bore, counterbore and boss enabling the bolt to be selectively positioned, within the bore, along a bore axis and along an axis other than the bore axis.

In some implementations, the present disclosure provides a pivoting system including a pivoting mount rotatably attached to a protrusion, the pivoting mount being selectively positioned in a pivoted state and an extended state, a bolt for rotatably connecting the pivoting mount to the protrusion, and a bore, a counterbore, and a boss disposed in the protrusion, the bolt being disposed at least partially within the bore, the bore, counterbore and boss enabling the bolt to be selectively positioned, within the bore, along a bore axis and along an axis other than the bore axis.

BRIEF DESCRIPTION OF THE DRAWINGS

To understand the present disclosure, it will now be described by way of example, with reference to the accompanying drawings in which implementations of the disclosures are illustrated and, together with the descriptions below, serve to explain the principles of the disclosure.

DETAILED DESCRIPTION

Figure 1:
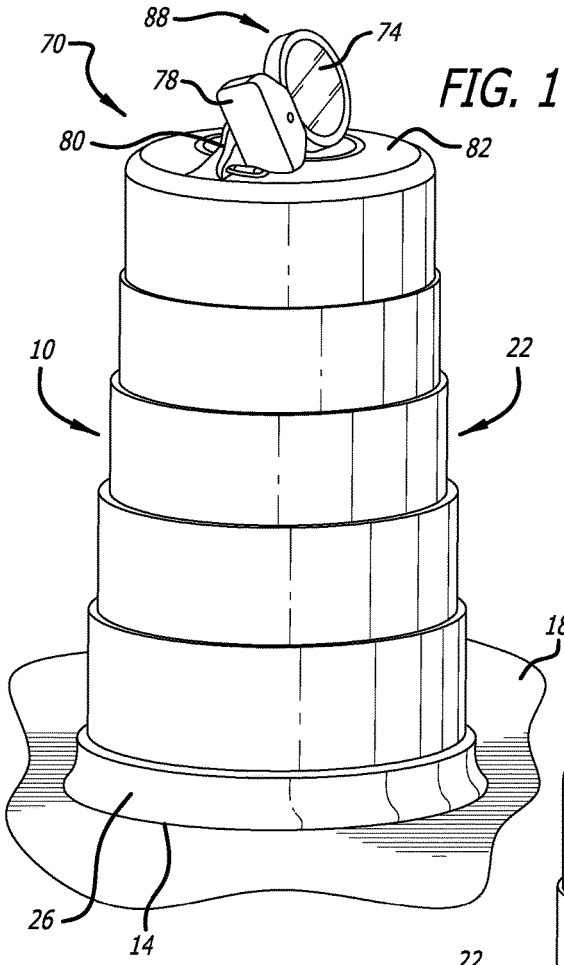
FIG. 1 is a perspective view of a traffic drum according to exemplary implementations of the present disclosure, showing a pivoting system in a pivoted position.

While the drum discussed herein may be implemented in many different forms, the disclosure will show in the drawings, and will herein describe in detail, implementations with the understanding that the present description is to be considered as an exemplification of the principles of the drum and is not intended to limit the broad aspects of the disclosure to the implementations illustrated.

A drum 10, or traffic drum, is commonly used to direct and alert road traffic to various road conditions. Although often used in conjunction with road traffic, drums 10 can also be employed in industrial, construction and crowd-control applications. Enhancements to the stability, portability and/or visibility of such drums are useful to increase drum 10 utility.

Figure 2:
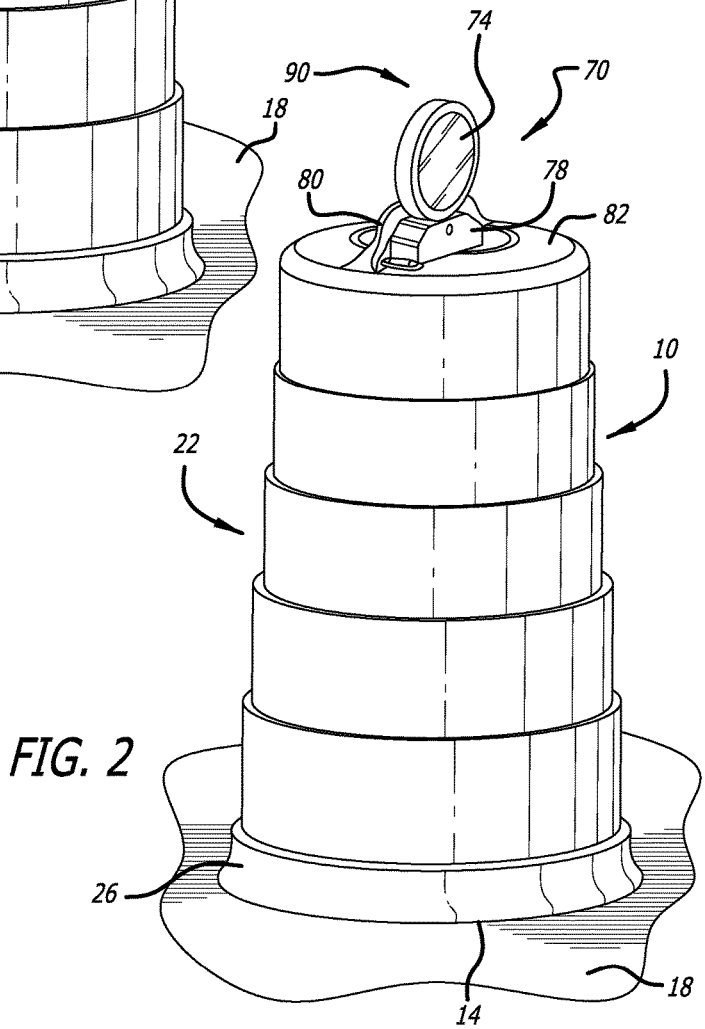
FIG. 2 is a perspective view of the traffic drum of FIG. 1, showing the pivoting system in a deployed, or extended, position.

Referring now to the figures, and initially to FIGS. 1 and 2, in some implementations the drum 10 includes a drum base 14, a vertical wall 22 and a skirt 26. The drum base 14 is in contact with a ground surface 18 when the drum 10 rests on the ground surface 18 in an upright orientation. Although often used on a level road surface, the drum 10 may also be positioned on a range of natural and fabricated ground surfaces 18. The drum 10 is formed primarily of a polymer material. However, the drum 10 may also include various metals, alloys or ceramics. Additionally, the drum 10 may be substantially cylindrical in certain sections, and each point on the drum 10 may correspond to an associated diameter.

In some implementations, the vertical wall 22 extends upwardly from the drum base 14 and may be oriented substantially perpendicularly to the ground surface 18 when the drum base 14 is in contact with the ground surface 18. The vertical wall 22 may include various visibility-enhancing features, such as reflective materials, light sources and one or more colors. Further, the vertical wall 22 may form various diameters, including diameters that change gradually or in a stepped manner. The skirt 26 may comprise a drum 10 section including a point with an increased diameter relative to that of other drum 10 sections.

In addition to the aforementioned features, exemplary implementations of the drum 10 include, and accommodate, a pivoting system 70. As shown in FIGS. 1 and 2, the pivoting system 70 may include a light 74 and a pivoting mount 78. The light 74 may enhance drum 10 visibility at night or in adverse conditions, and may be powered by an internal battery or an external power source. Further, the light 74 may include a Light Emitting Diode (LED), incandescent bulb, fluorescent bulb or other type of lighting source. Various reflective materials may be included on the light 74 or pivoting mount 78 to enhance the visibility and functionality of the light 74 and the pivoting system 70. In some implementations, the pivoting mount 78 mounts a flag or a sign in addition to, or instead of, the light 74.

The pivoting mount 78 is, in certain implementations, attached to the light 74, and is further rotatably attached to a handle 80. The handle 80 is disposed on a drum upper surface 82, and the drum upper surface 82 is located substantially opposite the drum base 14 on the drum 10. The handle 80, as best shown in FIGS. 3 and 4, includes a hand grip section 84 to ease manual drum 10 moving and handling.

Returning to FIGS. 1 and 2, the pivoting mount 78 is pivotable, or rotatable, between multiple positions for protecting the light 74, drum 10 or handle 80, or for facilitating drum 10 storage. In some implementations of the present disclosure, the pivoting system 70 is selectively positionable between a pivoted state 88 and an extended state 90. It is to be understood that other positions, or intermediate positions between the pivoted state 88 and the extended state 90, are also within the scope of this disclosure. FIG. 1 illustrates an example of the pivoting system 70 in the pivoted state 88, while FIG. 2 illustrates an example of the pivoting system 70 in the extended state 90. The pivoted state 88 may include the light 74 being located closer to the drum upper surface 82 as compared to a light 74 in the extended state 90, resulting in improved light 74 stability, security and packaging properties. Additionally, the extended state 90 may include the pivoting mount 78 being disposed substantially between the light 74 and the drum upper surface 82, while the pivoted state 88 may not include the pivoting mount 78 being disposed substantially between the light 74 and the drum upper surface 82.

Figure 3:
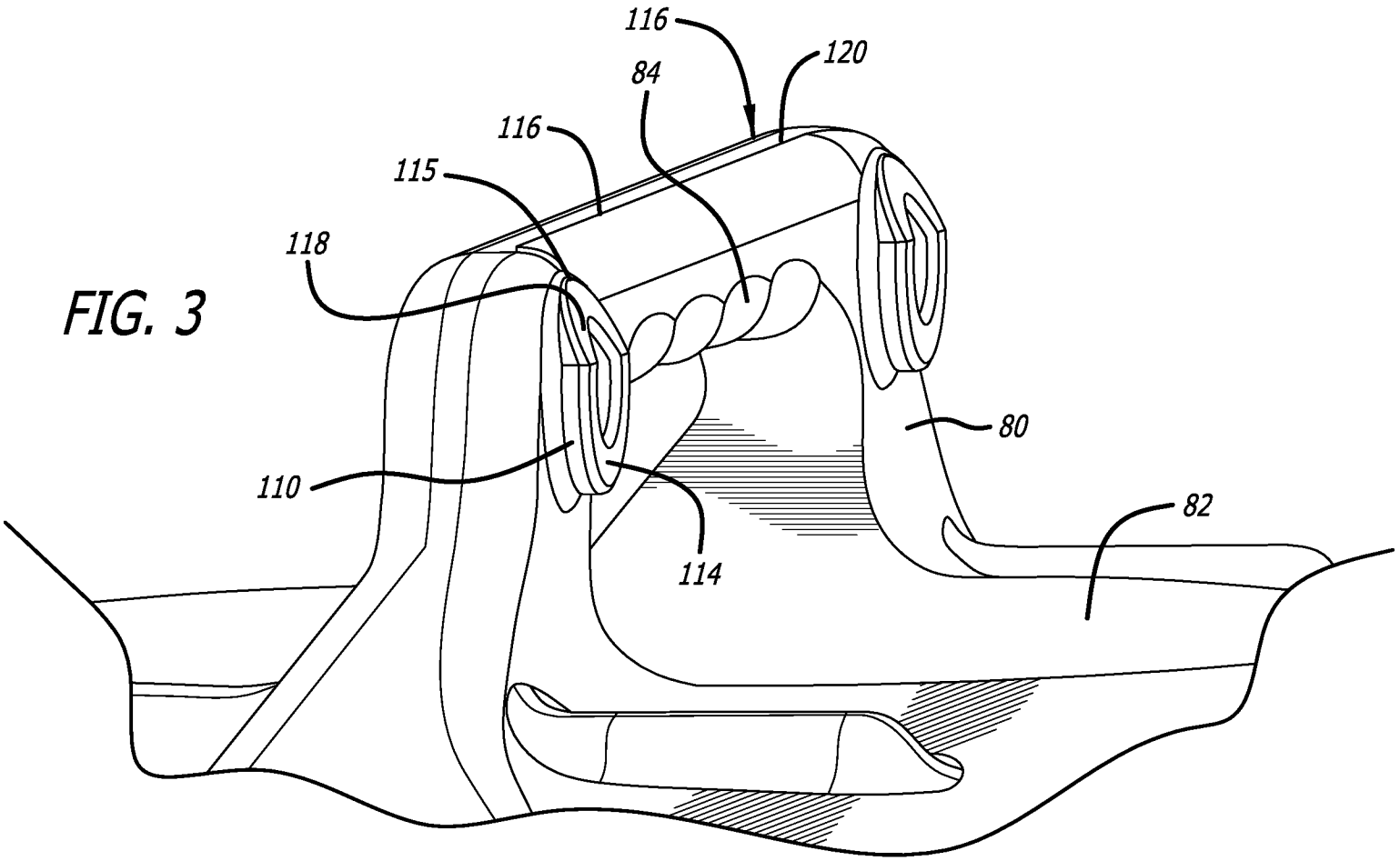
FIG. 3 is a perspective view of a handle according to exemplary implementations of the present disclosure.
Figure 4:
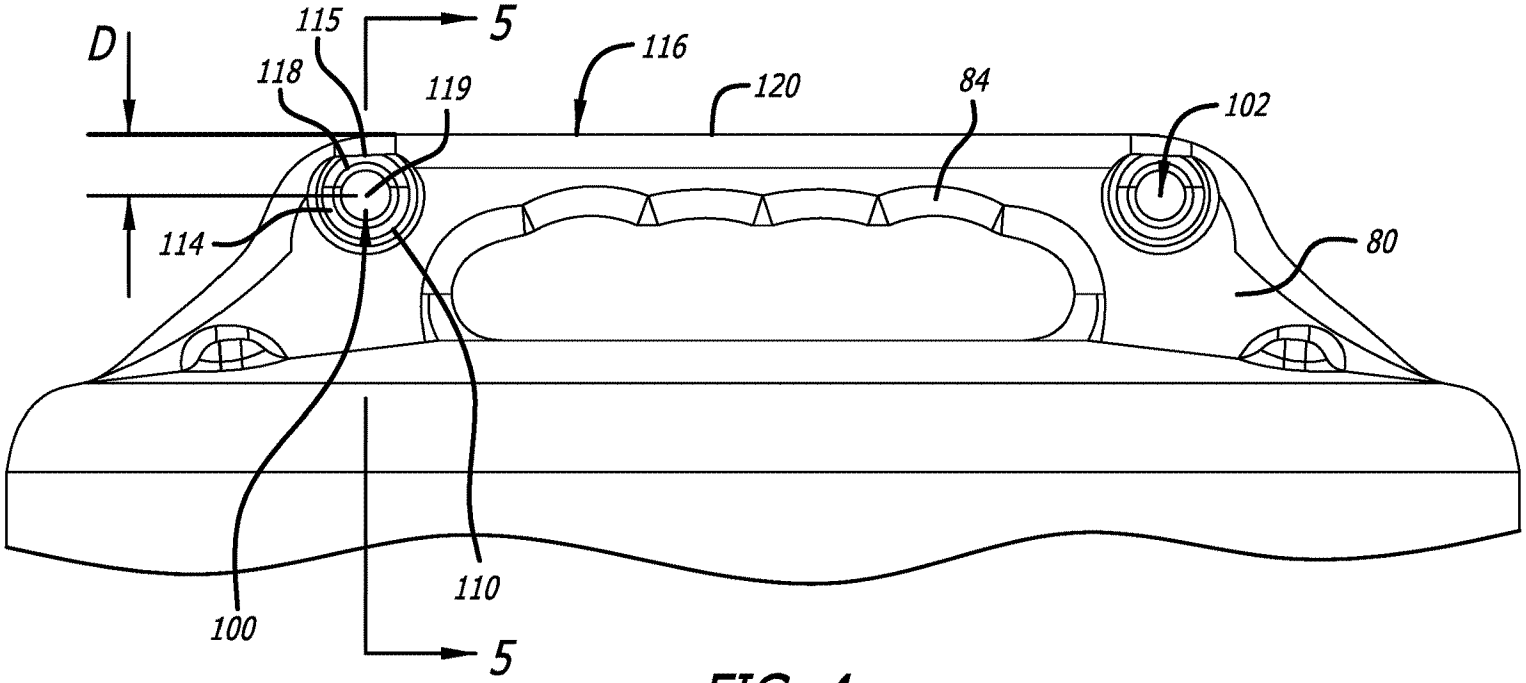
FIG. 4 is front view of the handle of FIG. 3.
Figure 5:
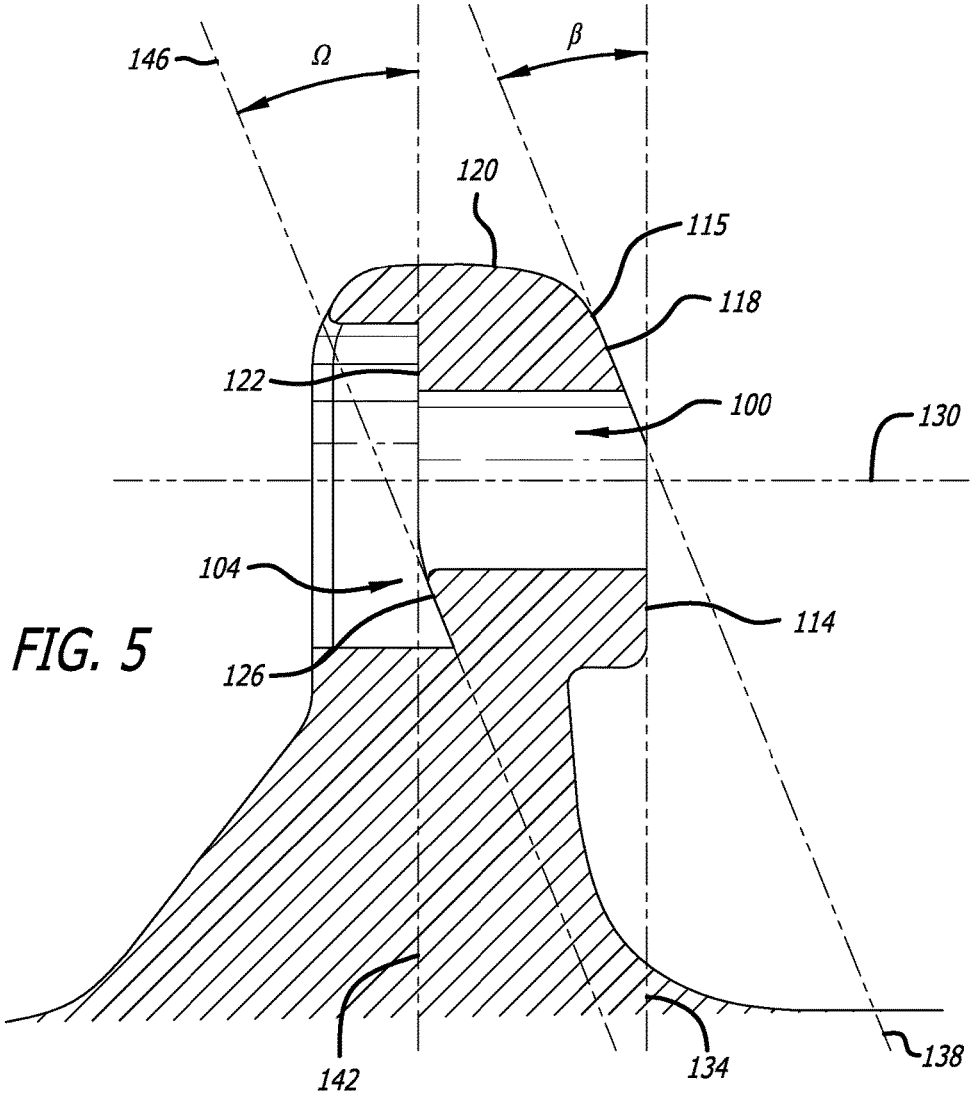
FIG. 5 is a cross-sectional view taken along line 5-5 of FIG. 4.

Turning now to FIGS. 3-5, the handle 80 includes a bore 100 passing through the handle 80. A second bore 102 may also be included in the handle 80 and may be structurally similar, or structurally identical, to the bore 100. A boss 110 surrounds a portion of the bore 100 and includes a boss surface 114 and a boss angled surface 118. The boss angled surface 118 is offset from the boss surface 114 by an acute angle, which is approximately 20 degrees in exemplary implementations. It is to be understood that all acute angles between the boss surface 114 and the boss angled surface 118 are within the scope of this disclosure. A boss vertex 115 is disposed on an upper portion of the boss angled surface 118, and the boss vertex 115, in some implementations, forms a portion of an upper handle surface 116. The boss vertex 115 may be defined as a point on the boss angled surface 118 located the greatest distance from the drum upper surface 82. Further, a distance D (FIG. 4) is measured between a center 119 of the bore 100 and an upper handle edge 120. In exemplary embodiments, the distance D is 0.700, 0.70, 0.71 or 0.710 inches.

As best shown in FIG. 5, the handle 80 also includes a counterbore 104. The counterbore 104 is, at least partially, aligned with the bore 100 such that the counterbore 104 and the bore 100 are arranged to cooperatively form a passage travelling completely through the handle 80. The counterbore 104 includes a counterbore surface 122 and a counterbore angled surface 126. The counterbore 104 includes a larger inner diameter than the bore 100. A bore axis 130 is defined by the bore 100. The counterbore angled surface 126 is offset from the counterbore surface 122 by an acute angle, which is approximately 20 degrees in exemplary implementations. It is to be understood that all acute angles between the counterbore surface 122 and the counterbore angled surface 126 are within the scope of this disclosure.

A boss surface axis 134 is substantially parallel with, and flush with, the boss surface 114 and a boss angled surface axis 138 is substantially parallel with, and flush with, the boss angled surface 118. An angle β exists between the boss surface axis 134 and the boss angled surface axis 138. The angle β is, in exemplary implementations, an acute angle. In some implementations, the angle β is approximately 20 degrees.

A counterbore surface axis 142 is substantially parallel with, and flush with, the counterbore surface 122, and a counterbore angled surface axis 146 is substantially parallel with, and flush with, the counterbore angled surface 126. An angle Ω exists between the counterbore surface axis 142 and the counterbore angled surface axis 146. The angle Ω is, in exemplary implementations, an acute angle. In some implementations, the angles β and Ω are substantially equal. In some implementations, the angle Ω is approximately 20 degrees. The bore axis 130 is substantially perpendicular with one or more of the boss surface 114, boss surface axis 134, counterbore surface 122 and counterbore surface axis 142. Further, the boss angled surface axis 138 is, in some implementations, substantially parallel with the counterbore angled surface axis 146.

Figure 6:
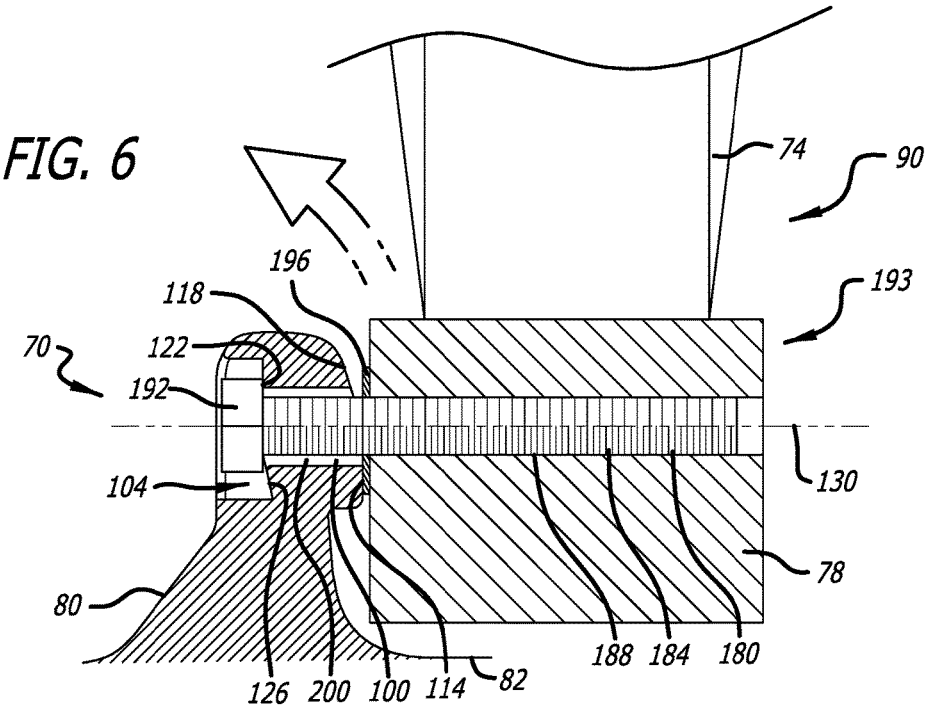
FIG. 6 is a cross-sectional view taken along line 5-5 of FIG. 4, also showing a bolt and elements of a pivoting system in an extended position, according to exemplary implementations of the present disclosure.
Figure 7:
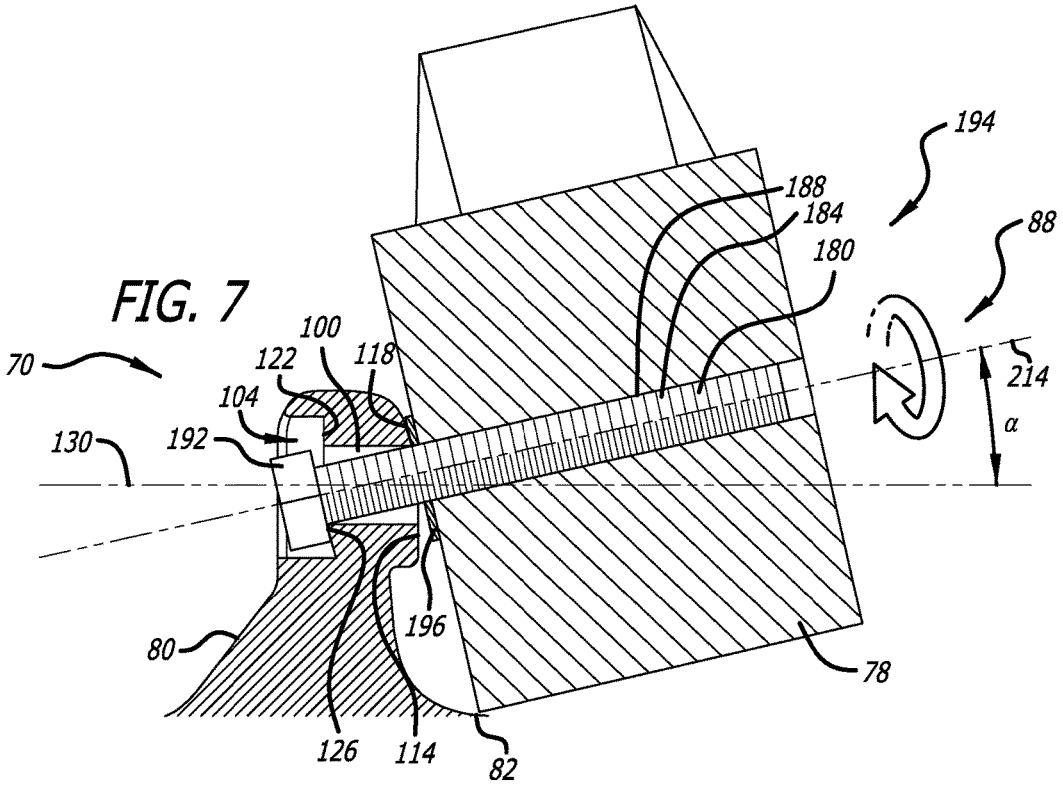
FIG. 7 is a cross-sectional view taken along line 5-5 of FIG. 4, also showing a bolt and elements of a pivoting system in a pivoted position, and further showing an angle $\alpha$ between a bore axis and an axis other than the bore axis, according to exemplary implementations of the present disclosure.

Turning now to FIGS. 6 and 7, a bolt 180 is disposed within one or both of the bore 100 and counterbore 104 within the handle 80. The bolt 180 includes a bolt threaded section 184 which engages with a mount threaded section 188 disposed within the pivoting mount 78. Such an engagement between the bolt 180 and the pivoting mount 78 securely, yet releasably, attaches the bolt 180 to the pivoting mount 78, and thus the pivoting mount 78 to the handle 80. In exemplary implementations, the pivoting mount 78 is attached to the bolt 180 such that a change in relative orientation between the pivoting mount 78 and the handle 80 corresponds to a change in relative orientation between the bolt 180 and the handle 80.

As described above, the bolt 180 connection between the handle 80 and the pivoting mount 78 enables the pivoting mount 78 to rotate between a pivoted state 88 and an extended state 90. In some implementations, the bolt 180 connection between the handle 80 and the pivoting mount 78 also enables the pivoting mount 78 to pivot between a lower pivotal state 193 and an upper pivotal state 194. The lower pivotal state 193 is illustrated in FIG. 6 while the upper pivotal state is illustrated in FIG. 7. In some implementations, the lower pivotal state 193 is used in conjunction with the extended state 90, as shown in FIG. 6, and the upper pivotal state 194 is used in conjunction with the pivoted state 88, as shown in FIG. 7.

The bolt head 192 is disposed on an opposite side of the bore 100 than is the bolt threaded section 184 and the pivoting mount 78, thus securing a rotatable and pivotal attachment between the handle 80 and the pivoting mount 78. The bolt head 192 includes a diameter larger than the bore 100, such that the bolt head 192 does not pass through the bore 100. In some implementations, the bolt 180 passes through the pivoting mount 78 and is secured using a nut, or another mechanical means, such that the pivoting mount 78 is rotatably and pivotally connected to the handle 80 by the bolt 180. However, some implementations include mechanical means other than a bolt 180 that enable such a rotational and pivotal relationship between the pivoting mount 78 and the handle 80.

When the pivoting mount 78 is selectively positioned in the lower pivotal state 193, the bolt 180, and/or the bolt threaded section 184, is disposed along the bore axis 130. When the pivoting mount 78 is selectively positioned in the upper pivotal state 194, the bolt 180, and/or the bolt threaded section 184, is disposed along an axis 214 other than the bore axis. An angle $\alpha$ between the bore axis 130 and the axis 214 other than the bore axis is an acute angle. In exemplary implementations, the angle $\alpha$ is approximately 20 degrees.

When the pivoting mount 78 is selectively positioned in the lower pivotal state 193, as shown in FIG. 6, at least a portion of a mount interfacing surface 196 on the pivoting mount 78 is substantially flush with, or is in contact with, at least a portion of the boss surface 114. When the pivoting mount 78 is selectively positioned in the upper pivotal state 194, as shown in FIG. 7, at least a portion of the mount interfacing surface 196 on the pivoting mount 78 is substantially flush with, or is in contact with, at least a portion of the boss angled surface 118.

When the pivoting mount 78 is selectively positioned in the lower pivotal state 193, as shown in FIG. 6, at least a portion of the bolt head 192 is substantially flush with, or is in contact with, at least a portion of the counterbore surface 122. When the pivoting mount 78 is selectively positioned in the upper pivotal state 194, as shown in FIG. 7, at least a portion of the bolt head 192 is substantially flush with, or is in contact with, at least a portion of the counterbore angled surface 126.

The bolt 180 is, in some implementations, aided in pivoting between an upper pivotal state 194 and a lower pivotal state 193 by properties of the handle 80, which may include physical compliance of certain materials such as polymers from which the handle 80 is made. Additionally, a circumferential gap 200 exists between the bolt threaded section 184 and the bore 100 in certain embodiments, as best shown in FIG. 6. Such a circumferential gap 200 results from a diameter of the bore 100 being larger than an outer diameter of the bolt threaded section 184. The circumferential gap 200 may also aid the bolt 180 in pivoting between the lower pivotal state 193 and the upper pivotal state 194.

In operation, the pivoting mount 78 may be in the extended state 90 and the lower pivotal state 193. The pivoting mount 78 is then manually pivoted into the upper pivotal state 194 and then manually rotated into the pivoted state 88. Similarly, the pivoting mount 78 may be in the pivoted state 88 and the upper pivotal state 194. The pivoting mount 78 is then manually rotated into the extended state 90 and then manually pivoted into the lower pivotal state 193. Such methods of operation cause reduced interference between the pivoting system 70 and the drum 10, handle 80 and/or drum upper surface 82. Such a reduction in interference may be exhibited while the pivoting system 70 is in the pivoted state 88, extended state 90, lower pivotal state 193, upper pivotal state 194, another state or transitioning between states, reducing fatigue or damage to various parts of the drum 10 or handle 80.

It is also contemplated that the handle 80 includes the second bore 102. In certain implementations, the second bore 102 is structurally identical or similar to the bore 100, such that all features of the bore 100 also apply to the second bore 102. In this manner, a second bolt, second pivoting mount and second pivoting system would interact with the second bore 102 in the same manner as described above with the bore 100. Further, in some implementations, the second bore 102 and bore 100 can each mount a bolt and pivoting system simultaneously, or at different times, on the same handle 80.

While some embodiments have been illustrated and described, numerous modifications come to mind without significantly departing from the spirit of the disclosure, and the scope of protection is only limited by the scope of the accompanying claims. Further, the present disclosure provides a sign base and a sign assembly having increased structural strength, improved aesthetic design, a footprint facilitating flexible sign base placement and a wheel arrangement allowing easy sign assembly transportation.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The invention claimed is:

1. A pivoting support system, comprising:

a support element;

a bore, a counterbore, and a boss formed in the support element;

a device; and a bolt rotatably connecting the device to the support element in a selective one of a main position and a pivoted position, wherein the bolt is disposed at least partially within the bore, the bore, counterbore and boss enabling the bolt to be selectively positioned, within the bore, along a bore axis and along an axis other than the bore axis.

2. The pivoting support system of claim 1, wherein a light is attached to the folding mount.

3. A pivoting support system, comprising:

a support element;

a bore formed in the support element and defining a bore axis;

a boss formed in the support element, and including a boss surface substantially perpendicular to the bore axis and a boss angled surface offset from the boss surface by a first acute angle;

a counterbore formed in the support element substantially coaxial with the bore, and including a counterbore surface substantially perpendicular to the bore axis and a counterbore angled surface offset from the counterbore surface by a second acute angle;

a device;

a bolt disposed at least partially within said bore and coupled to the device, wherein the device is rotatably and pivotally coupled to the support element by the bolt, and configured to be selectively positioned in at least one of a main position and a pivoted position.

4. The pivoting support system of claim 3, wherein the folding mount is attached to the bolt such that a change in relative orientation between the folding mount and the handle corresponds to a change in relative orientation between the bolt and the handle.

5. The pivoting support system of claim 3, wherein the first acute angle is substantially equal to the second acute angle.

6. The pivoting support system of claim 3, wherein a distance between a center of the bore and an upper handle edge is approximately 0.70 inches.

7. The pivoting support system of claim 3, wherein a vertex of the boss angled surface forms a part of an upper handle surface.

8. The pivoting support system of claim 3, wherein a light is attached to the folding mount.

9. The pivoting support system of claim 3, wherein at least one of the first and second acute angles is 20 degrees.

10. The pivoting support system of claim 3, wherein the handle is attached to an upper surface of a traffic drum.

11. The pivoting support system of claim 3, wherein the bolt is selectively positionable, within the bore, along the bore axis and along an axis other than the bore axis.

12. The pivoting support system of claim 11, wherein when the bolt is positioned along the bore axis, at least a portion of a mount interfacing surface of the folding mount is substantially flush with the boss surface.

13. The pivoting support system of claim 11, wherein when the bolt is positioned along the axis other than the bore axis, at least a portion of a mount interfacing surface of the folding mount is substantially flush with the boss angled surface.

14. The pivoting support system of claim 11, wherein when the bolt is positioned along the bore axis, at least a portion of a bolt head is substantially flush with the counterbore surface.

15. The pivoting support system of claim 11, wherein when the bolt is positioned along the axis other than the bore axis, at least a portion of a bolt head is substantially flush with the counterbore angled surface.

16. The pivoting support system of claim 11, wherein an angle between the bore axis and the axis other than the bore axis is approximately 20 degrees.

17. A traffic drum, comprising:

a base;

a drum upper surface disposed substantially opposite from the base on the drum;

a handle formed on the drum upper surface;

a bore, a counterbore, and a boss formed in the handle;

a device;

a bolt disposed at least partially within the bore, and rotatably connecting the device to the handle, such that the device is selectively positioned in one of a main position and a pivoted position, wherein the bore, counterbore and boss enable the bolt to be selectively positioned, within the bore, along a bore axis and along an axis other than the bore axis.

18. The traffic drum of claim 17, wherein the folding mount is attached to the bolt such that a change in relative orientation between the folding mount and the handle corresponds to a change in relative orientation between the bolt and the handle.

19. The traffic drum of claim 17, wherein a light is attached to the folding mount.

20. The traffic drum of claim 17, wherein a distance between a center of the bore and an upper handle edge is approximately 0.70 inches.

* * * * *